United States Patent [19]

Gundlach

[11] 3,985,560

[45] Oct. 12, 1976

[54] MIGRATION IMAGING MEMBER WITH FUSIBLE PARTICLES

[75] Inventor: Robert W. Gundlach, Victor, N.Y.

[73] Assignee: Xerox Corporation, Stamford, Conn.

[22] Filed: July 29, 1971

[21] Appl. No.: 167,521

Related U.S. Application Data

[62] Division of Ser. No. 851,872, Aug. 21, 1969, Pat. No. 3,648,607.

[52] U.S. Cl. ..... 96/1.5; 96/1.8

[51] Int. Cl.[2] ..... G03G 5/06; G03G 5/08

[58] Field of Search ..... 96/1.5, 1.8, 1 R, 1.2; 117/21, 37 LE; 252/62.1

[56] References Cited

UNITED STATES PATENTS

| | | | |
|---|---|---|---|
| 3,121,006 | 2/1964 | Middleton et al. | 96/1.5 |
| 3,234,017 | 2/1966 | Heyl et al. | 252/501 X |
| 3,281,240 | 10/1966 | Cassiers et al. | 96/1.5 |
| 3,337,340 | 8/1967 | Matkan | 117/37 LE |
| 3,378,370 | 4/1968 | Brancato | 96/1.8 |
| 3,384,488 | 5/1968 | Fulagin et al. | 96/1.5 X |
| 3,397,086 | 8/1968 | Bartfai | 96/1.5 X |
| 3,634,135 | 1/1972 | Akiyama et al. | 96/1.5 X |
| 3,656,990 | 4/1972 | Goffe | 96/1 R |

FOREIGN PATENTS OR APPLICATIONS

| | | | |
|---|---|---|---|
| 709,348 | 5/1965 | Canada | 96/1 R |

*Primary Examiner*—Roland E. Martin, Jr.

[57] ABSTRACT

A migration imaging system having a migration imaging member with a binder layer of softenable material wherein a mixture of electrically photosensitive and inert fusible particles is dispersed and an imaging process wherein the fusible particles are fused thereby fixing the migrated image of the two types of particles. The imaged member is used as a lithographic printing master.

7 Claims, 7 Drawing Figures

MIGRATION IMAGING MEMBER WITH FUSIBLE PARTICLES

CROSS REFERENCE TO RELATED APPLICATIONS

This is a division of application Ser. No. 851,872, filed Aug. 21, 1969 now U.S. Pat. No. 3,648,607.

BACKGROUND OF THE INVENTION

This invention relates to a novel imaging system in which the recording material is selectively moved through a softenable medium under the influence of electrical forces, and particularly to fixing such migration images after they have been formed.

Recently, a migration imaging system capable of producing high quality images of high density, continuous tone, and high resolution has been developed. Such migration imaging systems are disclosed in copending applications Ser. No. 837,780, filed June 30, 1969, and Ser. No. 837,591, filed June 30, 1969. In a typical embodiment of that system an imaging member comprising a substrate, a layer of softenable material and photosensitive marking material is latently imaged by electrically charging the member and exposing the uniformly electrically charged member to a pattern of activating electromagnetic radiation such as light. The exposed marking particles migrate toward the substrate when the member is developed by softening the softenable layer.

"Softenable" as used herein is intended to mean any material which can be rendered more permeable thereby enabling particles to migrate through its bulk. Conventionally, changing permeability is accomplished by heat or solvent softening. "Fracturable" layer or material as used herein, means any layer or material which is capable of breaking up during development, thereby permitting portions of said layer to migrate towards the substrate or to be otherwise removed. The fracturable layer may be particulate, semi-continuous, or continuous in different embodiments.

There are other systems for forming the latent image, wherein non-photosensitive or inert, fracturable layers and particulate marking material may be used to form said images, as described in the aforementioned copending applications which also disclose a variety of methods which may be used to form latent images upon migration imaging members.

Likewise, various means for developing latent images in the novel migration imaging system are known. Typical developing means include solvent wash-away; solvent vapor softening, heat softening and combinations of these methods.

When certain development techniques are used in the migration imaging system of the present invention, the layer of softenable material may be substantially completely washed away, typically along the unmigrated marking material, leaving behind an image pattern of migrated marking material on the substrate. It has been found that the resultant image of marking material on the substrate may be in a fragile and easily damageable condition because the marking material is relatively loose and unfixed. This image is susceptible to smudging, scratching, smearing, or other undesirable defacing when handled by the human hand or when coming in contact with any abrasive instrument or other material. Such destructive displacement of the image of an imaged migration imaging member typically also reduces the physical and optical density of the desired image.

Such an unfixed migration image is useful in that it is observable and is a potential fixed migration image, but in its fixed conditions has the disadvantage of normally being unsuitable for use in any but delicate, non-contact applications which would preclude its use in hard copy applications such as microfilm.

Various methods and materials as well as combinations of methods and materials have previously been used to fix such unfixed migration images. For example fixing methods and materials previously used are disclosed in copending applications Ser. No. 590,959, filed Oct. 31, 1966, and Ser. No. 695,214, filed Jan. 2, 1968. However, in addition to the methods and materials previously used to fix such migration images, there is a continuing need for better methods and materials suitable for fixing such migration images.

SUMMARY OF THE INVENTION

It is, therefore, an object of this invention to provide means for fixing a migration image which overcome the above-noted deficiencies and satisfy the above-noted needs.

It is another object of this invention to provide a novel migration imaging member.

It is another object of this invention to provide a novel migration imaging member.

It is another object of this invention to provide a method for fixing migration images.

It is another object of this invention to provide a method for fixing migration images.

It is another object of this invention to provide materials suitable for fixing migration images.

It is yet another object of this invention to provide a system for protecting migration images.

It is still another object of this invention to provide a system for fixing migration images which does not degrade the image resolution, density, or other quality.

It is another object of this invention to provide a method for preparing lithographic printing masters.

It is another object of this invention to provide a novel lithographic printing system.

The foregoing objects and others are accomplished by a migration imaging system wherein the migration imaging member is a binder layer of softenable material wherein a mixture of photosensitive and inert, fusible particles is dispersed, and an imaging process wherein the fusible particles are fused thereby fixing the migrated image of the two types of particles. The imaged member then may be used as a lithographic printing master.

BRIEF DESCRIPTION OF THE DRAWINGS

For a better understanding of the invention as well as other objects and further features thereof, reference is made to the following detailed disclosure of the preferred embodiments of the invention taken in conjunction with the accompanying drawings thereof, wherein.

DESCRIPTION OF THE PREFERRED EMBODIMENTS

Figure 1:
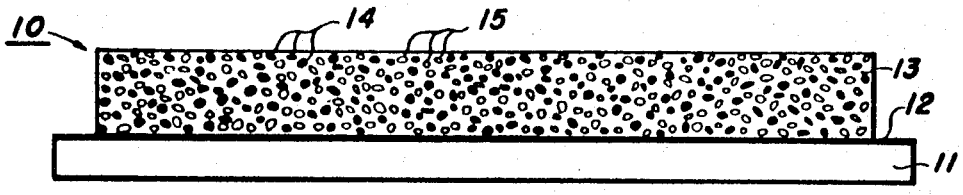
FIG. 1 is a partially schematic cross-sectional view of a preferred embodiment of the novel migration imaging member.
Figure 2A:
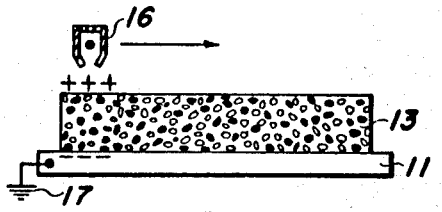
FIGS 2*a* - 2*e* are partially schematic cross-sectional views of a preferred imaging member undergoing the steps of the preferred migration imaging process.
Figure 2B:
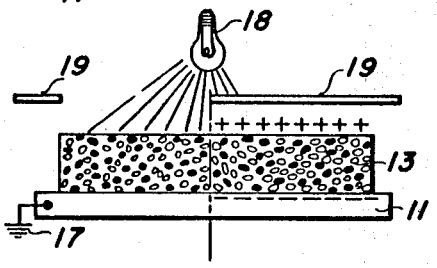

In FIG. 1 a preferred embodiment of the novel migration imaging member suitable for use in the novel migration imaging system of the present invention is illustrated in cross-section wherein the imaging member 10 comprises substantially transparent substrate 11 having substantially transparent conductive layer 12 thereon, and matrix of softenable material 13 wherein a mixture of electrically photosensitive particles 14 and inert fusible particles 15 are dispersed, is coated upon the substrate.

The substrate, in various preferred embodiments of the migration imaging member, may be electrically conductive or insulating, and transparent or opaque. Conductive substrates generally facilitate the charging of the member in the electrical-optical mode of the migration imaging system as described earlier. Such conductive substrates include copper, brass, nickel, zinc, chromium, stainless steel, conductive plastics and rubbers, conductive paper, aluminum, steel, cadmium, silver, gold and others. Insulating substrates may include glass, insulating paper, plastics such as Mylar polyester, and others. As previously noted, the substrate may already be coated with the softenable layer, or alternatively, the softenable layer may be self-supporting and brought into contact with a suitable substrate during imaging. Substrates may be in any suitable form such as a metallic strip, sheet, plate, coil, cylinder, drum, endless belt, moebius strip, circular disk, or the like. Combination substrates having a conductive substrate coating on an insulating member may be constructed, and combinations such as tin oxide coated on glass available under the trademark "NESA" from Pittsburgh Plate Glass Co., and aluminized polyester film, aluminized "Mylar" (E. I. duPont deNemours Co.), or Mylar coated with copper iodide, may be used as transparent, conductive substrates.

The softenable layer, which may comprise one or more layers of softenable materials, may be any suitable material, typically a plastic or thermoplastic material, which is softenable, for example, in a liquid solvent, solvent vapor, heat or combinations thereof. In many modes of the migration imaging member, the softenable layer is substantially electrically insulating during the migration force applying and softening steps of the migration imaging process. The softenable layer should preferably be substantially electrically insulating in many modes of the migration imaging system; however, more conductive materials may be used in various other modes because of increased capabilities of electrically applying a constant and replenishing supply of charges in image configuration to the migration imaging member. Where the softenable layer is to be dissolved either during or after imaging, it should be soluble in a solvent which does not attack the marking particles used in the migration imaging member. The softenable layer is typically of a thickness in the range between about ½ micron and about 16 microns.

Typical substantially electrically insulating softenable materials include, for example, Staybelite Ester 10, a partially hydrogenated rosin ester, Floral Ester, a hydrogenated rosin triester, and Neolyne 23, an alkyd resin, all from Hercules Powder Co.; SR type silicone resins available from General Electric Corporation; Sucrose Benzoate, Eastman Chemical; Velsicol X-37, a polystyreneolefin copolymer from Velsicol Chemical Corp.; Hydrogenated Piccopale 100, Piccopale H-2, highly branched polyolefins, Piccotex 100, a styrene-vinyl toluene copolymer, Piccoplastic A-75, 100 and 125, all polystyrenes, Piccodiene 2215, a polystyreneolefin copolymer, all from Pennsylvania Industrial Chemical Corp.; Araldite 6060 and 6071, epoxy resins from Ciba; R5061A, a phenylmethyl silicone resin, from Dow Corning; Epon 1001, a bisphenol A-epichlohydrin epoxy resin, from Shell Chemical Corp.; and PS-2 PS-3, both polystyrenes, and ET-693, a phenolformaldehyde resin, for Dow Chemical; custome synthesized copolymers of styrene and hexylmethacrylate, a custom synthesized polydiphenylsiloxane; a custom synthesized polyadipate; acrylic resins available under the trademark Acryloid from Rohm and Haas Co., and available under the trademark Lucite from the E. I. duPont deNemours & Co.; thermoplastic resins available under the trademark Phiolite from the Goodyear Tire & Rubber Co.; a chlorinated hydrocarbon available under the trademark Aroclor from Monsanto Chemical Co.; thermoplastic polyvinyl resins available under the trademark Vinylite from Union Carbide Co.; polyterpine resin available under the name NIREZ 1085 from Tenneco Chem., Inc.; other thermoplastics disclosed in Gunther et al U.S. Pat. No. 3,196,011; waxes and blends, mixtures and copolymers thereof.

Photosensitive materials for marking particles 14 permit the imaging members hereof to be latently imaged by the optimum electrical-optical mode hereof. Typical photosensitive materials include inorganic or organic photoconductive insulating materials; materials which undergo conductivity changes when photoheated, for example, see Cassiers, Photog, Sci: Engr. 4. No. 4, 199 (1960); materials which photoinject, or inject when photoheated.

Preferred inorganic photoconductors for use herein because of the excellent quality of the resultant images include amorphous selenium; amorphous selenium alloyed with arsenic, tellurium, antimony or bismuth, etc.; amorphous selenium or its alloys doped with halogens; and mixtures of amorphous selenium and the crystalline forms of selenium including the monoclinic and hexogonal forms. Other typical inorganic photoconductors include cadium sulfide, zinc oxide, cadmium sulfoselenide, cadmium yellows such as Lemon Cadmium Yellow X-2273 from Imperial Color and Chemical Dept. of Hercules Powder Co., and many others. Middleton et al U.S. Pat. No. 3,121,006 lists typical inorganic photoconductive pigments. Typical organic photoconductors include azo dyes such as Watchung Red B, a barium salt of 1-(4'methyl-5'chloro-azo- benzene-2'-sulfonic acid)-2-hydrohydroxy-3-napthoic acid, C. I. No. 15865, a quinacridone, Monastral Red B, both available from DuPont; Indofast double scarlet toner, a Pyranthrone-type pigment available from Harmon Colors; qunido magenta RV-6803, a quinacridone type pigment available from Harmon Colors; Cyan Blue, GTNF, the beta form of copper phthalocyanine, C. I. No. 74160, available from Collway Colors; Monolite Fast Blue GS, the alpha form of metalfree phthalocyanine, C. I. No. 74100, available from Arnold Hoffman Co.; commercial indigo available from National Aniline Division of Allied Chemical Corp.; yellow pigments prepared as disclosed in copending applications Ser. No. 421,281, filed Dec. 28, 1964, or as disclosed in Ser. No. 445,235, filed Apr. 2, 1965, X-form metal-free phthalocyanine prepared as disclosed in copending application Ser. No. 505,723, filed Oct. 29, 1965, quinacridonequinone from DuPont, sensitized polyvinyl carbazole, Diane Blue, 3,3'-methoxy-4,4'-diphenyl-bis(1''azo-2'' hydroxy-3''naphthanilide), C. I. No. 21180, available from Harmon Colors; and Algol G. C., 1,2,5,6-di (D,D'-diphenyl)-thiazoleanthraquinone, C. I. No. 67300, available from General Dyestuffs and mixtures thereof. The above list of organic an inorganic photoconductive photosensitive materials is illustrative of typical materials, and should not be taken as a complete listing of photo-sensitive materials.

Any suitable photosensitive material or mixtures of such materials may be used in carrying out the invention, regardless of whether the particular material selected is organic, inorganic, is made up of one or more components in solid solution or dispersed one in the other.

Other materials which may be included in photosensitive migration marking material include organic donor-acceptor (Lewis acid-Lewis base) charge transfer complexes made up of donors such as phenolaldehyde resins, phenoxies, epoxies, polycarbonates, urethanes, styrene or the like complexed with electron acceptors such as 2,4,7-trinitro-9-flourenone; 2,4,5,7-tetranitro-9-fluorenone; picric acid; 1,3,5-trinitro benzene; chloranil; 2,5-dichlorobenzoquinone; anthraquinone-2-carboxylic acid, 4-nitrophenol; maleic anhydride; metal halides of the metals and metalloids of groups I-B and II-VIII of the periodic table including for example, aluminum chloride, zinc chloride, ferric chloride, magnesium chloride, calcium iodide, strontium bromide, chromic bromide, arsenic triiodide, magnesium bromide, stannous chloride etc.; boron halides, such as boron trifluorides; ketones such as benzophenone and anisil, mineral acids such as sulfuric acid; organic carboxylic acids such as acetic acid and maleic acid, succinic acid, citroconic acid, sulphonic acid, such as 4-toluene sulphonic acid and mixtures thereof.

The electrically photosensitive material or particles, portions of which migrate to the substrate during image formation, may comprise any suitable electrically photosensitive material capable of selectively discharging the imaging member in areas illuminated during imagewise exposure.

Electrically photosensitive particles as used herein refers to any particles which when dispersed in a softenable, electrically insulating binder or matrix layer as described herein, in reponse to elecrical charging, imagewise exposure to activating radiation, and contact with suitable softening media, are caused to selectively deposit in image configuration on a substrate.

While photoconductive particles, (and "photoconductive" is used in its broadest sense to mean particles which show increased electrical conductivity when illuminated with electromagnetic radiation and not necessarily those which have been found to be useful in xerography in xerographic pigment-binder plate configurations) have been found to be a class of particles useful as "electrically photosensitive" particles in this invention and while the photoconductive effect is often sufficient in the present invention to provide an "electrically photosensitive" material, it does not appear to be a necessary effect. Apparently the necessary effect according to the invention is the selective relocation of charge into, within or out of the materials or particles, said relocation being effected by light acting on the bulk or surface of the "electrically photosensitive" material, by exposing said material or particle to activating radiation which may specifically include photoconductive effects, photoinjection, photoemission, photochemical effects and others which cause said selective relocation of charge.

Where the binder structured imaging member comprising marking material dispersed throughout the layer of softnable material is used in the migration imaging process of this invention, it is believed that uniformly electrically charging and imagewise exposure with activating electromagnetic radiation typically results in a selective collapsing of the electrical field across the imaging member in the exposed areas, while the field remains in unexposed areas.

In various preferred embodiments of the present invention the fusible inert particles may be used in conjunction with electrically photosensitive particles 14 which themselves may or may not be fusible. In another preferred embodiment of the present invention the fusible inert particles 15 and electrically photosensitive particles 14 may be mutually fusible thereby producing a blended, fused mass of migration material in a fixed image.

Materials suitable for use as inert, fusible migration material in the advantageous system of the present invention include P-1700-618 Magenta Fluorescent Pigment, available from Radiant Color Company, Richmond, California; vinylidene fluoride available under the name Kynar from Pennsalt Chemical Co.; polystyrene; Zytel 101 nylon available from DuPont; polyethylene; Radiant Fluorescent Pigment available from Radiant Color Co.; Saran resin, F242-L from Dow Chemical Co., Midland, Michigan; 3M Scotchcast Electrical Insulating Resin available from the 3M Co., ST. Paul, Minnesota; powdered polyvinyl alcohol available from DuPont; VYLF, a blend of vinyl chloride and vinyl acetate, blend 1705 and 507, available from Union Carbide Plastics Div., S. Charleston, West Virginia; Tetran, a variation of Teflon available from Pennsalt Chemical Corp.; polyvinyl fluoride available as Dalvar 720 from Diamond Shamrock, Cleveland, Ohio; powdered chloride available from Dow Chemical, and mixtures thereof.

Where the binder structured imaging member is used in the inventive system, or in any other configuration where some of the inert fusible material may be situated between the photosensitive material and the source of activating radiation, substantially transparent inert fusible particles would be more advantageous because they would absorb less activating radiation and therefore would affect the sensitivity of the imaging member to a lesser degree than less transparent or opaque fusible materials.

The fusible characteristic of these inert fusible materials is the ability of the materials to soften or reduce their viscosities to a point at which adjacently located fusible particles combine into a substantially indistinguishable mass of the fusible material. It is intended that this fusing step take place at conditions which are different from the conditions which will cause development of the migration imaging member by softening the softenable layer of said member. These fusing conditions for example may include the controlled application of a solvent for the inert fusible particles after the development step, application of a solvent for said fusible material which which does not affect the material of the softenable material, or heating the developed member to a temperature sufficiently high to heat-fuse the inert fusible particles. Presently suitable inert fusible materials generally fuse when heated to temperatures in the range between about 400°F and about 600°F.

The particulate migration materials suitable for use in the inventive system whether photosensitive or inert fusible particles, are typically of a size about 2 microns or less. Such particles are preferably of size in the range between about 0.02 microns and about 0.5 microns.

It has been found that in the inventive system imaging members having photosensitive marking material in amounts in the range between about 2 to about 30 percent by weight of softenable material and inert fusible materials in amounts in the range between about 5 to about 25 percent by weight of softenable material are preferred. Ratios of photosensitive to inert fusible materials in the range between about 1:1 and about 1:2 are also preferred. For example, a composition of about 10 percent photosensitive material, 15 percent inert fusible material and about 75 percent softenable material is preferred for use in such imaging members.

A preferred embodiment of the imaging process of the advantageous system of the present invention is illustrated in FIG. 2. In FIG. 2*a* the preferred imaging member as described in FIG. 1 is shown being electrostatically charged by corona charging device 16 while the substantially conductive substrate is grounded at 17, thereby creating an electrical field across softenable layer 13. In FIG. 2*b* the charged imaging member is shown being exposed to a light-and-shadow image created on the imaging member by light source 18 projected through optical mask 19. This exposure step is typically done in darkroom conditions. In this preferred electrical-optical mode of the migration imaging process, the electrically photosensitive particles 14 become sufficiently electrically conductive when exposed to light, to discharge the field across softenable layer 13 created by the electrostatic charged deposited during the charging step. In FIG. 2*c* the imaged migration imaging member is shown being rinsed, or wash-away developed, in a bath of solvent 20, suitable for dissolving softenable layer 13 but incapable of substantially dissolving the migration materials 14 and 15. The wash-away development step is carried out in a bath 20 in any suitable container 21, and the dissolving softenable layer and unmigrated marking and migration materials 14 and 15 are shown dissolving away from the imaging member at 22. It is noted that in the advantageous system of the present invention the inert fusible particles 15 migrate and deposit in unexposed image areas along with the photosensitive particles 14. In FIG. 2*d* the developed imaging member is shown wherein the migrated layer of marking materials 14 and 15 is shown at 23 in imagewise configuration in the unexposed areas of the imaging member. The fusing step of the advantageous system of the present invention is illustrated in FIG. 2*e* wherein means suitable for causing the migration materials to fuse here illustrated at 24 as an electric resistance heating device are shown carrying out the fusing step in the imaging process. In various embodiments of the inventive system, other means for fusing the particles image may be used. For example, radiant heating by any source of radiant heat-even lasers, conductive heating (as by contacting the imaging member with a heated platent or cylinder), or convective heating (as in an oven), or combinations thereof may be used to effect fusing. Also, various solvents or solvent vapors may similarly cause the desired fusing to take place. The fused, imaged member shown in FIG. 2*e* at 25 illustrates the preferred embodiment of the advantageous system of the present invention wherein the inert fusible particles 15 fused around the electrically photosensitive migration marking particles 14, thereby permanently attaching the marking particles 14 to the sustrate, and also providing said marking particles with a protective overcoating.

Figure 3:
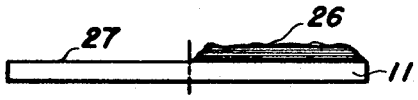
FIG. 3 is a partially schematic cross-sectional view of an imaged member produced by a preferred migration imaging process.

Another preferred embodiment of the fused, imaged migration imaging member is illustrated in FIG. 3 wherein the electrically photosensitive particles 14 and inert fusible particles 15 are mutually fusible thereby providing a fused, imaged member wherein the fused, imaged areas 26 are a single, blended mass of migration marking materials which are permanently attached to the substrate and are no longer susceptible to destructive displacement by contact with other materials.

In other embodiments of migration imaging members having a layer of softenable material and a mixture of photo-sensitive and inert fusible marking materials, the marking materials may be disposed in a fracturable layer contiguous the upper surface of the softenable layer wherein the marking material may be slightly, partially or substantially embedded in the surface of the softenable layer, or coated thereon. One such preferred embodiment comprises a softenable layer having particles of the inert fusible material dispersed throughout the softenable layer and a fracturable layer of photosensitive material contiguous the surface of the softenable layer.

Figure 2C:
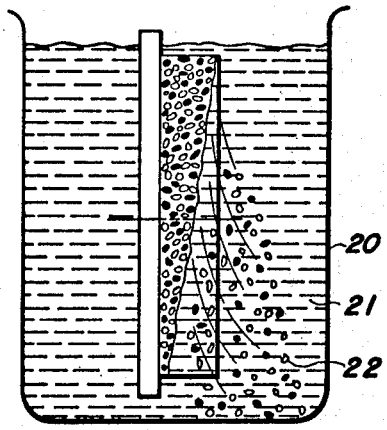
Figure 2D:
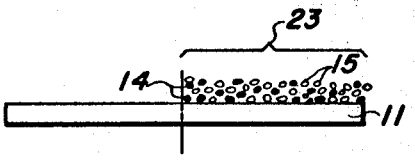
Figure 2E:
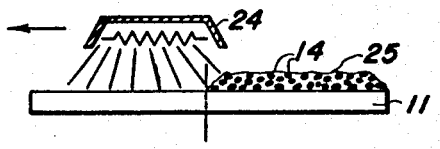

As clearly illustrated in FIG. 2*e* and FIG. 3, the fused, imaged member typically comprises substrate 11 having imaged areas 25 or 26 in imagewise configuration and raised to a level substantially above the surface 27 of substrate 11. Because the image areas are substantially raised above the surface 27 of the substrate 11, the imaged member of the present invention is particularly adapted to the production of lithographic printing masters suitable for use in making multiple copies of the desired image configuration. Preferred lithographic printing masters are produced by the system of the present invention wherein the materials used in the imaging master member are selected for their characteristics which are most advantageous in the printing system in which the masters are to be used. For example, where the master is to be used with water base inks like Scripto permanent black available from the W. A. Shaeffer Pen Company, Ft. Madison, Iowa, the materials in the master will typically be selected so that the substrate is hydrophobic and the deposited image areas 25 are 26 are hydrophilic and are wettable by such water base inks. Similarly, where other inking systems are used, other materials may be preferred for use in the master. A variety of lithographic printing inks and wetout solutions are described in application Ser. No. 633,916, filed Apr. 26, 1967.

The lithographic printing master image as illustrated in FIG. 2*c* or FIG. 3 is used for printing by first inking said master with an ink applicator roller or any other suitable inking means. The inked printing master is then contacted with a suitable ink-receptive surface onto which it is desired that the master image be printed. The ink-receptive substance to which the image is transferred may be any opaque or transparent surface upon which the printed image is desired. Such transfer materials may typically be paper, wood, transparent plastics, glass or any other suitable surface material. Alternatively, the image may be transferred to a resilient intermediate surface such as a rubber blanket, from which it in transferred to the final receiving surface. The image transferring, surface contacting step, as well as the inking step of course may be repeated as many times and as often as desired to produce the desired number and quality of lithographic images.

The printing master of the present invention may be prepared in any configuration which will facilitate their use in printing processes. For example, the master described as easily produced on flexible substrate 11 which are suitable for mounting upon the surface of a rotatable cylinder or any other physical configuration which may facilitate multiple and continuous printing.

The following examples further specifically define the present invention with respect to providing a migration imaging system wherein the migrated imaging material is fusibly attached to a substrate and thereby protected from otherwise image-destroying contact with other materials. The parts and percentages are by weight unless otherwise indicated. The examples below are intended to illustrate various preferred embodiments of the novel migration imaging member and process.

EXAMPLE I

A binder structured imaging member according to the present invention is prepared by mixing the coating comprising about 100 parts by weight Nirez 1085, a polyterpene resin from Tenneco Chemicals, Inc.; about 15 parts X-form metal-free phthalocyanine; about 100 parts Sohio 3454, a refined kerosene from the Standard Oil Company of Ohio; about 20 parts Kynar, vinylidene fluoride available from the Pensal Chemical Corp.; and about 4 parts 2,6-di-tert-butyl-p-cresol, an anti-oxidant which reduces aging, available from the Eastman Kodak Co., Rochester, New York. The coating mix is blended for about two hours and twenty minutes in a ball mill Red Devil paint shaker having about ⅛ inch steel milling balls. The prepared coating is roll coated onto a conductive substrate of about 5 mil aluminum foil available from American Lamotite Corp., using a No. 3 wire wound Meier rod. The freshly coated substrate is then oven dried for about 1 hour at about 50°C. This imaging member is then suitable for imaging in the charge-expose mode of the present invention as described in Example III and this system produces lithographic printing masters suitable for use in printing as described in Example IV.

EXAMPLE II

A binder structured imaging member suitable for use in the present invention is produced by preparing a coating comprising about 100 parts Nirez, 15 parts *x*-form metal-free phthalocyanine, 100 parts Sohio 3440 solvent, and 25 parts polystyrene resin of molecular weight of about 30,000 and blending the coating mixture for about 2½ hours in a ball mill. The blending reduces the polystyrene particle size to about 1 or 2 microns. The prepared coating is then roll coated onto a substrate comprising an A.B. Dick aluminum offset plate of thickness of about 0.0035 inch available from A.B. Dick Duplicating Products, Chicago, Illinois, the roll coating being accomplished with a No. 6 wire wound Meier rod. The coated member is then oven dried for about 45 minutes at about 65°C.

The imaging master member produced in this way includes inert fusable particles which are substantially transparent and which thereby allow light impinging upon the imaging member during the charge-expose mode of imaging, to be transmitted through said inert particles which may be located between the source of radiation and the photosensitive particles in the imaging member. This member is suitable for imaging for use as a lithographic printing master.

EXAMPLE III

Using the structure of Example II, with the substrate of the member electrically grounded, the member is corona charged under darkroom conditions to a positive potential of about 200 volts. After or during charging an image pattern of activating electromagnetic radiation, here visible light, is projected onto the surface of the member, thereby selectively discharging the member in the exposed areas. The member is then exposed to an atmosphere of air saturated with trichloroethylene vapors, which exposure is performed for about 5 seconds while the member is still under darkroom conditions. The member is then removed from trichloroethylene atmosphere and allowed to dry in ambient room light for at least about 5 seconds, and the member is then again corona charged in ambient room light with a charging current equal to the initial sensitizing charge. The recharged member is then immersed in a gently agitated bath of trichloroethylene for about 10 seconds, during which time the Nirez is substantially dissolved and rinsed away and carries with it the unmigrated particles of phthalocyanine and polystyrene from the areas illuminated during the image exposure step, while the migration particles in the unexposed areas adhere to the substrate. The member is removed from the rinse developing bath and heated to about 200°C for about 10 seconds. This heating step softens the polystyrene particles which fuse together thereby forming a binder structure throughout the image areas. The member is cooled to room temperature and then comprises a tough, visible, positive-to-positive reproduction of the original image in raised image configuration on the substrate. This member is suitable for use as an offset lithographic printing master.

EXAMPLE IV

An imaging member is produced as in Example II and imaged as in EXAMPLE III and is suitable for use as a lithographic printing master. The background areas of the imaged member are made more water receptive by a short etching rinse in Colitho Etch, available from Columbia Ribbon & Carbon Co., Glen Cove, Long Island, New York. This printing master is then mounted on an offset duplicating machine and swabbed with A.B. Dick Fountain solution. A commercial printing ink, A.B. Dick 4020 Black Ink, available from A.B. Dick Co., Chicago, Illinois, is used in the duplicating machine, and multiple copies are produced on 20 wt. bond paper. More than 10,000 copies may be made from a single printing master using this method.

For storage for future use, after using as above, the printing master is wipe-coated with gum arabic to prevent oxidation of its background areas.

EXAMPLE V

An imaging member according to the present invention is prepared by mixing in a ball mill particles of p-1700-618 Magenta Fluorescent Pigment, available from Radiant Color Co., Richmond, California, of average diameter of about 0.5 microns in a Stabelite Ester 10 binder in a ratio of pigment to binder of about 1:1. The binder mixture is coated onto an aluminized "Mylar" substrate, an aluminum coated polyester film available from duPont, and the binder mixture coat has a thickness of about 2 microns. A fracturable migration layer of zinc oxide particles of average size less than about 0.5 microns is coated over the free surface of the Stabelite-Magenta binder layer, and this zinc oxide layer is about 0.5 microns in thickness.

This member is uniformly electrostatically charged to a negative surface potential of about 250 volts and imagewise exposed with about 200 f.c.s. light. The latently imaged member is developed by immersion in a bath of Freon 113 solvent, a fluorinated hydrocarbon available from duPont, for about 1–2 seconds and then removed.

A sharp positive image is formed by this procedure, and this imaged member is used as a lithographic printing master in the process of Example III.

Although specific components and proportions have been stated in the above description of the preferred embodiments of the novelmigration imaging and fixing system, other suitable materials and variations in the various steps in the system as listed herein, may be used with satisfactory results and various degrees of quality. In addition, other materials and steps may be added to those used herein and variations may be made in the process to synergize, enhance, or otherwise modify the properties of the invention.

It will be understood that various other changes in the details, materials, steps, and arrangements of elements which have been herein described and illustrated in order to explain the nature of the invention, will occur to and may be made by those skilled in the art, upon a reading of this disclosure and such changes are intended to be included within the principal and scope of this invention.

What is claimed is:

1. An imaging member comprising a substrate, a layer of softenable material on said substrate, said softenable layer comprising softenable material containing electrically photosensitive migration marking particles and a sufficient amount of fusible particles to insure fusing of a migration image, one of said substrate and said fusible photosensitively inert migration particles being substantially transparent; wherein said electrically photosensitive migration marking particles are a fracturable layer contiguous the surface of said softenable layer opposite said substrate and contacting said softenable layer.

2. An imaging member comprising a substrate, a layer of softenable material on said substrate, said softenable layer comprising softenable material containing electrically photosensitive migration marking particles and a sufficient amount of fusible particles to insure fusing of a migration image, one of said substrate and said fusible photosensitively inert migration particles being substantially transparent; wherein the substrate is substantially electrically insulating.

3. An imaging member comprising a substrate, a layer of softenable material on said substrate, said softenable layer comprising softenable material containing electrically photosensitive migration marking particles and a sufficient amount of fusible particles to insure fusing of a migration image, one of said substrate and said fusible photosensitively inert migration particles being substantially transparent; wherein said electrically photosensitive particles are X-form, metal-free phthalocyanine.

4. An imaging member comprising a substrate, a layer of softenable material on said substrate, said softenable layer comprising softenable material containing electrically photosensitive migration marking particles and a sufficient amount of fusible particles to insure fusing of a migration image, one of said substrate and said fusible photosensitively inert migration particles being substantially transparent; wherein the fusible electrically photosensitively inert particles comprise polystyrene resin.

5. An imaging member comprising a substrate, a layer of softenable material on said substrate, said softenable layer comprising softenable material containing electrically photosensitive migration marking particles and a sufficient amount of fusible particles to insure fusing of a migration image, one of said substrate and said fusible photosensitively inert migration particles being substantially transparent; wherein the fusible electrically photosensitively inert particles comprise vinylidene fluoride.

6. An imaging member comprising a substrate, a layer of softenable material on said substrate, said softenable layer comprising softenable material containing electrically photosensitive migration marking particles and a sufficient amount of fusible particles to insure fusing of a migration image, one of said substrate and said fusible photosensitively inert migration particles being substantially transparent; wherein the substrate is an aluminum sheet.

7. An imaging member comprising a substrate, a layer of softenable material on said substrate, said softenable layer comprising softenable material containing electrically photosensitive migration marking particles and a sufficient amount of fusible particles to insure fusing of a migration image, one of said substrate and said fusible photosensitively inert migration particles being substantially transparent; wherein said electrically photosensitive migration marking particles are present in amounts in the range from about 2 to about 30 percent by weight of softenable material, and said fusible electrically photosensitive inert migration marking particles are present in amounts in the range from about 5 to about 30 percent by weight of softenable material.

* * * * *